US008782907B2

(12) United States Patent
Chong

(10) Patent No.: US 8,782,907 B2
(45) Date of Patent: Jul. 22, 2014

(54) ALL-IN-ONE MULTIPURPOSE EATING UTENSIL ADAPTED TO BE SEPARATED INTO PIECES

(71) Applicant: Edward Chong, Glendale, CA (US)

(72) Inventor: Edward Chong, Glendale, CA (US)

( * ) Notice: Subject to any disclaimer, the term of this patent is extended or adjusted under 35 U.S.C. 154(b) by 0 days.

(21) Appl. No.: 13/722,300

(22) Filed: Dec. 20, 2012

(65) Prior Publication Data

US 2014/0173909 A1 Jun. 26, 2014

(51) Int. Cl.
*A47G 21/06* (2006.01)

(52) U.S. Cl.
USPC ..... 30/142; 30/147; 30/148; 30/149; 30/150

(58) Field of Classification Search
CPC ..... A47G 21/00; A47G 21/02; A47G 21/04; A47G 21/06; B26B 11/00; B25F 1/00
USPC ..... 30/123, 147–150, 322–328; D7/642–664, 686, 687; 294/3, 99.2, 294/218; 7/110–113, 158
See application file for complete search history.

(56) References Cited

U.S. PATENT DOCUMENTS

| | | | | | |
|---|---|---|---|---|---|
| 33,730 | A | * | 11/1861 | Ames | 30/147 |
| 1,053,387 | A | * | 2/1913 | Hawley | 30/147 |
| 1,806,441 | A | * | 5/1931 | Bauer et al. | 7/110 |
| 2,455,623 | A | * | 12/1948 | Stone | 30/322 |
| 2,752,678 | A | * | 7/1956 | Welch | 30/324 |
| 2,877,547 | A | * | 3/1959 | Feaster | 30/322 |
| 3,136,416 | A | * | 6/1964 | Goldrosen | D7/637 |
| 3,386,837 | A | * | 6/1968 | Arnot | 206/0.5 |
| 3,389,412 | A | * | 6/1968 | Emmons | 30/147 |
| D220,205 | S | * | 3/1971 | Salla | 30/147 |
| 3,596,965 | A | * | 8/1971 | Woofter | 30/150 |
| 3,664,020 | A | * | 5/1972 | Hammond et al. | D7/644 |
| 3,727,306 | A | * | 4/1973 | Patik | 294/3 |
| 3,829,350 | A | * | 8/1974 | Davis, Jr. et al. | D7/645 |
| D233,398 | S | * | 10/1974 | Lee | D7/642 |
| 3,937,510 | A | * | 2/1976 | Lew | D7/687 |
| D242,760 | S | * | 12/1976 | Jensen | D7/644 |
| 4,159,182 | A | * | 6/1979 | Adolfson | 30/150 |
| D254,229 | S | * | 2/1980 | Julius | D7/643 |

(Continued)

FOREIGN PATENT DOCUMENTS

| | | | |
|---|---|---|---|
| AT | 375255 B | * | 7/1984 |
| CH | 704263 A1 | * | 6/2012 |

(Continued)

OTHER PUBLICATIONS

Korean Office Action dated Nov. 1, 2013 of the corresponding Korean Patent Application No. 10-2011-0116183.

*Primary Examiner* — Jason Daniel Prone
(74) *Attorney, Agent, or Firm* — Christie, Parker & Hale, LLP

(57) ABSTRACT

An all-in-one multipurpose eating utensil can be used for consuming food. Specifically, a dual-purpose spoon with fork-like functions, dual-purpose chopsticks with knife-like functions, and/or a toothpick are combined into one single device or apparatus. By fusing these detachable utensils into a single unit, users only need to transport and supply one multipurpose eating utensil to provide all the utensils necessary to freely enjoy a meal. This all-in-one eating utensil enables efficient production and convenience of use by allowing users to dine with spoon with fork-functions and chopsticks with knife-like functions.

5 Claims, 6 Drawing Sheets

(56) References Cited

U.S. PATENT DOCUMENTS

| | | | | | |
|---|---|---|---|---|---|
| 4,199,180 | A * | 4/1980 | Kelly | D7/686 |
| 4,317,284 | A * | 3/1982 | Prindle | 30/147 |
| 4,377,035 | A * | 3/1983 | Dalichow | 30/147 |
| 4,521,964 | A * | 6/1985 | Maruyama | 30/148 |
| 4,524,512 | A * | 6/1985 | Formo et al. | 30/147 |
| D279,852 | S * | 7/1985 | Yokoyama | D7/642 |
| D284,442 | S * | 7/1986 | Chan | D7/645 |
| 4,707,922 | A * | 11/1987 | Hosak-Robb | 30/322 |
| 4,789,064 | A * | 12/1988 | Segal | 248/37.3 |
| 4,809,435 | A * | 3/1989 | Printz | 30/142 |
| 4,863,033 | A * | 9/1989 | Buj | 30/123 |
| 4,930,637 | A * | 6/1990 | DeRoseau | 220/521 |
| D310,465 | S * | 9/1990 | Bonasia | D7/644 |
| 5,054,835 | A * | 10/1991 | Loechel et al. | 294/3 |
| 5,056,173 | A * | 10/1991 | Brincat | 7/112 |
| 5,161,691 | A * | 11/1992 | Vulliez | 30/142 |
| 5,261,560 | A * | 11/1993 | Wang | 30/323 |
| 5,327,650 | A * | 7/1994 | Rojas | 30/147 |
| 5,373,640 | A * | 12/1994 | Cordeiro, Jr. | 30/142 |
| D362,160 | S * | 9/1995 | Brabeck et al. | D7/645 |
| 5,649,728 | A * | 7/1997 | Warthen | 294/5 |
| D384,249 | S * | 9/1997 | Puri | D7/643 |
| D386,050 | S * | 11/1997 | Puri | D7/644 |
| D388,664 | S * | 1/1998 | Gagnon et al. | D7/643 |
| 5,791,053 | A * | 8/1998 | Koong | 30/142 |
| 5,845,403 | A * | 12/1998 | Nivin | 30/147 |
| 5,904,250 | A * | 5/1999 | De Schutter | 30/142 |
| 6,457,238 | B1 * | 10/2002 | Maier et al. | 30/142 |
| 7,013,568 | B2 * | 3/2006 | Schmidt | 30/147 |
| D529,767 | S * | 10/2006 | Huber | D7/643 |
| D539,615 | S * | 4/2007 | Weaver | D7/643 |
| D601,389 | S * | 10/2009 | Brown | D7/643 |
| 7,628,432 | B2 * | 12/2009 | Flather | 294/3 |
| 7,646,000 | B2 * | 1/2010 | Shih | 250/455.11 |
| D609,060 | S * | 2/2010 | Pallotto | D7/643 |
| D625,153 | S * | 10/2010 | Gallop et al. | D7/645 |
| 7,856,722 | B2 * | 12/2010 | Lago-Arenas | 30/147 |
| 7,878,563 | B2 * | 2/2011 | Beckham et al. | 294/218 |
| 7,905,021 | B2 * | 3/2011 | Shirazi | 30/147 |
| D644,071 | S * | 8/2011 | Vanguard | D7/643 |
| 8,079,390 | B2 * | 12/2011 | Bigsby et al. | 144/348 |
| 8,176,751 | B2 * | 5/2012 | Chen | 294/218 |
| D662,320 | S * | 6/2012 | De Leo | D7/641 |
| 8,333,418 | B2 * | 12/2012 | Gosai | 294/218 |
| D674,667 | S * | 1/2013 | Hassanpour Aghdam | D7/653 |
| D674,668 | S * | 1/2013 | Hassanpour Aghdam | D7/643 |
| 2002/0073553 | A1 * | 6/2002 | Yang | 30/150 |
| 2002/0092181 | A1 * | 7/2002 | Choi | 30/324 |
| 2004/0051327 | A1 * | 3/2004 | Yoon | 294/99.2 |
| 2005/0269825 | A1 * | 12/2005 | Lee | 294/1.1 |
| 2007/0006465 | A1 * | 1/2007 | Lee | 30/142 |
| 2007/0033809 | A1 * | 2/2007 | Shirazi | 30/147 |
| 2007/0101578 | A1 * | 5/2007 | Shirazi | 30/147 |
| 2008/0000092 | A1 * | 1/2008 | Vanguard | 30/147 |
| 2008/0022534 | A1 * | 1/2008 | Kim | 30/142 |
| 2008/0036226 | A1 * | 2/2008 | Yoon | 294/3 |
| 2009/0126204 | A1 * | 5/2009 | Wagner et al. | 30/345 |
| 2009/0165307 | A1 * | 7/2009 | Lam et al. | 30/123 |
| 2009/0217532 | A1 * | 9/2009 | Cantu | 30/123 |
| 2009/0241347 | A1 * | 10/2009 | Weaver | 30/142 |
| 2010/0000096 | A1 * | 1/2010 | Muehlemann | 30/322 |
| 2010/0052347 | A1 * | 3/2010 | Teng | 294/99.2 |
| 2010/0107417 | A1 * | 5/2010 | Crisp | 30/322 |
| 2010/0218382 | A1 * | 9/2010 | Scott | 30/147 |
| 2010/0299932 | A1 * | 12/2010 | Misawa | 30/148 |
| 2010/0301620 | A1 * | 12/2010 | Tow | 30/148 |
| 2011/0035946 | A1 * | 2/2011 | Menceles | 30/147 |
| 2011/0049391 | A1 * | 3/2011 | Yang | 250/492.1 |
| 2011/0061240 | A1 * | 3/2011 | Kazama et al. | 30/150 |
| 2011/0078907 | A1 * | 4/2011 | Beckham et al. | 30/142 |
| 2011/0132392 | A1 * | 6/2011 | Crisp | 132/309 |
| 2011/0138632 | A1 * | 6/2011 | Wong | 30/149 |
| 2011/0296693 | A1 * | 12/2011 | Oakes | 30/142 |
| 2012/0103356 | A1 * | 5/2012 | Crisp | 30/150 |
| 2012/0110746 | A1 * | 5/2012 | Allard Serrano et al. | 30/142 |
| 2012/0222311 | A1 * | 9/2012 | Wang et al. | 30/123 |
| 2012/0272527 | A1 * | 11/2012 | Brown | 30/123 |
| 2013/0200643 | A1 * | 8/2013 | Marshall, III | 294/106 |
| 2013/0233864 | A1 * | 9/2013 | Kilpatrick | 220/574.1 |
| 2013/0247387 | A1 * | 9/2013 | Dietz | 30/345 |
| 2014/0033541 | A1 * | 2/2014 | Crisp | 30/147 |
| 2014/0059783 | A1 * | 3/2014 | Lu et al. | 7/158 |

FOREIGN PATENT DOCUMENTS

| | | | | |
|---|---|---|---|---|
| DE | 373231 | C | * | 4/1923 |
| DE | 661572 | C | * | 6/1938 |
| DE | 713303 | C | * | 11/1941 |
| DE | 728379 | C | * | 11/1942 |
| DE | 1778170 | A1 | * | 7/1971 |
| DE | 2119969 | A1 | * | 10/1972 |
| DE | 4429303 | C2 | * | 10/1997 |
| DE | 102009030050 | A1 | * | 3/2011 |
| EP | 0257109 | A1 | * | 3/1988 |
| EP | 0129495 | B1 | * | 6/1988 |
| EP | 0965297 | A1 | * | 12/1999 |
| EP | 1316260 | A1 | * | 6/2003 |
| EP | 1741369 | A1 | * | 1/2007 |
| FR | 2642632 | A1 | * | 8/1990 |
| FR | 2698772 | A1 | * | 6/1994 |
| GB | 191422621 | A | * | 0/1915 |
| GB | 518152 | A | * | 2/1940 |
| GB | 530161 | A | * | 12/1940 |
| GB | 579949 | A | * | 8/1946 |
| GB | 2350778 | A | * | 12/2000 |
| GB | 2452978 | A | * | 3/2009 |
| HU | 214461 | B | * | 3/1998 |
| JP | 11042173 | A | * | 2/1999 |
| JP | 2000093282 | A | * | 4/2000 |
| JP | 2000135172 | A | * | 5/2000 |
| JP | 2003169740 | A | * | 6/2003 |
| JP | 2004180913 | A | * | 7/2004 |
| JP | 2004305133 | A | * | 11/2004 |
| JP | 2006051059 | A | * | 2/2006 |
| JP | 2007014714 | A | * | 1/2007 |
| JP | 2007301312 | A | * | 11/2007 |
| JP | 2007319635 | A | * | 12/2007 |
| JP | 2007330741 | A | * | 12/2007 |
| JP | 2008136730 | A | * | 6/2008 |
| JP | 2010094475 | A | * | 4/2010 |
| KR | 10-2005-0080144 | | | 8/2005 |
| KR | 10-2006-0097511 | | | 9/2006 |
| KR | 10-2007-0016904 | | | 2/2007 |
| WO | WO 9108086 | A1 | * | 6/1991 |
| WO | WO 9508286 | A1 | * | 3/1995 |
| WO | WO 9511609 | A1 | * | 5/1995 |
| WO | WO 2005030016 | A1 | * | 4/2005 |
| WO | WO 2005074352 | A2 | * | 8/2005 |
| WO | WO 2007083887 | A1 | * | 7/2007 |
| WO | WO 2011006275 | A1 | * | 1/2011 |
| WO | WO 2011156485 | A3 | * | 4/2012 |

* cited by examiner

-- PRIOR ART --

ALL-IN-ONE MULTIPURPOSE EATING UTENSIL ADAPTED TO BE SEPARATED INTO PIECES

BACKGROUND

1. Field

Aspects of embodiments according to the present invention relate to eating utensils.

2. Description of Related Art

When consuming food, the proper utensils are commonly chosen depending on types of food and culinary culture. Typically, forks and knives are used in the West, while spoons and/or chopsticks are used in Eastern countries like Korea, China and Japan.

These days, a variety of cultural exchanges has allowed people to come in contact with foreign culinary cultures, which has led to wider use of the different types of eating utensils mentioned above.

Especially, proper utensils are needed depending on different types of food. In order to consume soup or salad, one needs a spoon or a fork respectively, while forks and knives are used in order to consume meat-based meals. On the other hand, chopsticks are used when taking a small portion of food or sampling side dishes. Situations often arise that require some, or all, of these utensils together.

Moreover, when eating out, most people use toothpicks when they are done with consuming meals to get rid of any food that is stuck between their teeth. Therefore, a spoon 130, a fork 110, a knife 100, chopsticks 140 and a toothpick 120, as shown in FIG. 1, for example, should be procured before consuming a meal.

However, because the utensils mentioned above (spoons, forks, knives, chopsticks, toothpicks) are produced independently, users have to prepare each utensil independently before using them. Furthermore, the burden is increased even more when dining outdoors or picnicking as it is inconvenient to supply and transport all the necessary eating utensils.

Because of the inconvenience caused by having all the utensils separately, most people usually use disposable plastic spoons and wooden chopsticks when dining outdoors. However, users also need to prepare disposable utensils separately because those utensils are produced and sold separately. Furthermore, when people try to consume meat products, diners have a hard time consuming the meal due to the lack of forks and knives and must resort to bad table manners such as using their teeth to bite chunks from a large piece of meat they hold up using chopsticks.

In addition, people usually forget to bring toothpicks whenever they are eating outside. Consequently, people usually break wooden chopsticks into a sharp splinter to get rid of any food stuck between their teeth. This is not only inconvenient but dangerous as well since people can cut their gums on the sharp splinters.

The utensils listed above are typically used for lunch boxes, picnics or camping, and they are also used at snack bars and restaurants. Preparing and providing all of these separate utensils is not only an inconvenience, but users may also forget to pack specific utensils from time to time. There is also the inconvenience from having to wash all the utensils after they have been used which can take up considerable time and effort.

SUMMARY

In embodiments according to the present invention, above problems associated with having to provide separate utensils are resolved. A spoon with integrated fork tines, chopsticks integrating serrated knife-like edges, and/or a toothpick may be manufactured as a single unit. The chopsticks may contain a bulge along the outer edge near the middle of the chopsticks with serrations, so that they can also function as knives. Those chopsticks also are connected at the top part. A spoon that has fork-like tines is connected in between the chopsticks. A toothpick connects the inner top part of the chopsticks and the top part of the spoon to complete the formation.

These utensils can be separated so that each utensil can perform its own function if needed. After meals, any food stuck between teeth can be removed by using the toothpick included in this multipurpose utensil. According to embodiments of the present invention, a versatile all-in-one eating utensil is provided.

According to embodiments of the present invention, chopsticks that are connected at their upper ends and diverged towards the bottom ends may be provided. A spoon is located in between the chopsticks. Additionally, a toothpick may be located in between the upper part of chopsticks and the spoon. The inner part of the chopstick and the outer part of the spoon are connected by Connector 1 which can be separated if proper pressure is applied. The upper part of the spoon and the bottom part of the toothpick are connected by Connector 2. Connector 3 connects the upper part of the toothpick and the upper, inner surface of the chopsticks. The outer surface of the chopsticks is shaped with an outward bulge containing knife-like serrations, and the bottom portion of the spoon is formed like a fork. This invention is intended to allow the usage of chopsticks, a spoon, fork, knife, and toothpick from one single device or apparatus.

By producing a spoon, chopsticks, and a toothpick as one single device or apparatus, the embodiments of the present invention allow users to carry, manage, and store the utensils conveniently. This versatile all-in-one eating utensil is detachably structured so that users can use the product conveniently by separating the attached utensils to yield a spoon and chopsticks depending on their needs. Because the spoon also contains fork tines and the chopsticks have a serrated knife-like edge, users can use the spoon and chopsticks as a fork and a knife as well. Hence, this utensil allows users to consume any suitable type of meal conveniently. Moreover, the toothpick can be detached and used to pick food from in between teeth after a meal. Therefore, the product is remarkable in its convenience.

The embodiments of the present invention relate to a multipurpose all-in-one eating utensil that allows consumption of a variety of foods. In particular, a spoon with fork-like features, chopsticks with knife-like features, and/or a toothpick are produced as a single unit; where said chopsticks have an outward bulge with saw-toothed serrations on their outer surface and are connected at their top ends, the top end of a spoon formed with fork-tines at the bottom portion is connected to the inside surface the chopsticks, and a toothpick connects the top end of the chopsticks with the top end of the spoon.

The three parts may be produced (e.g. through injection molding) as a single, fused unit that is convenient to handle, store, and transport. The package can be easily dismantled when the need for various eating utensils arise. The Spoon-Fork and Chopstick-Knife parts may be paired to serve as either a spoon and chopstick combination of a fork and knife combination. The remaining toothpick part may be used to clear food residue from teeth.

DETAILED DESCRIPTION

Any terminology or words used herein can be defined by the inventor in order to better explain the invention and is intended to provide adequate descriptions without necessarily limiting the scope of the invention thereto. As such, the definition of terms or words used herein should not be limited to general or dictionary definitions only. Further, any terminology or words herein should also be construed such that their definition or meaning conforms to the technological spirit of the present invention. An example embodiment of the present invention will be described in detail, with references to the accompanying drawings.

Figure 1:
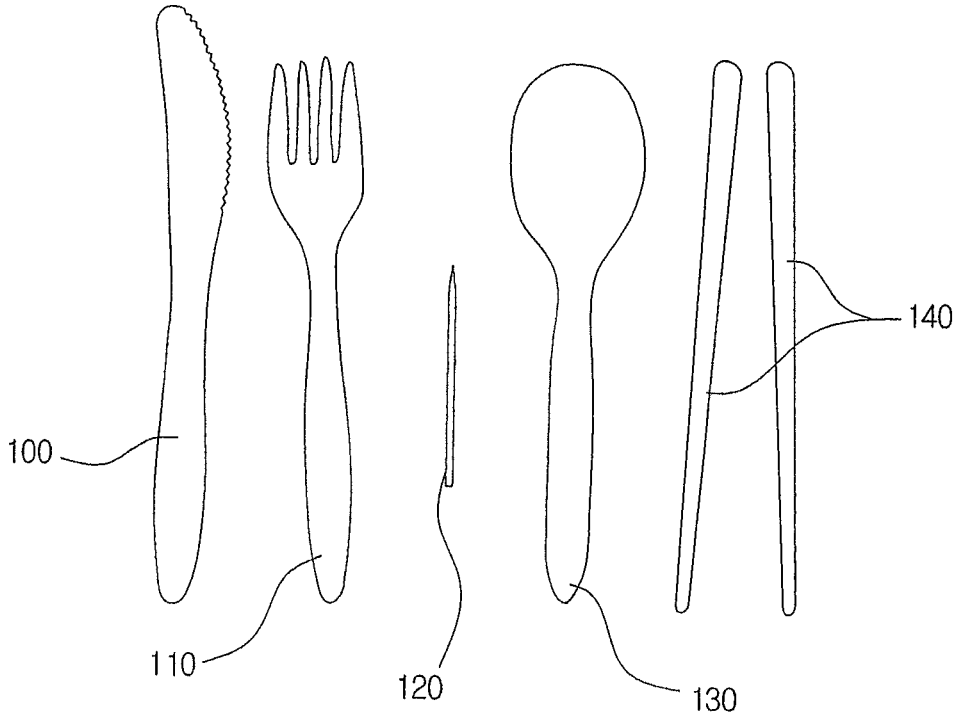
FIG. 1 depicts typical eating utensils.
Figure 2:
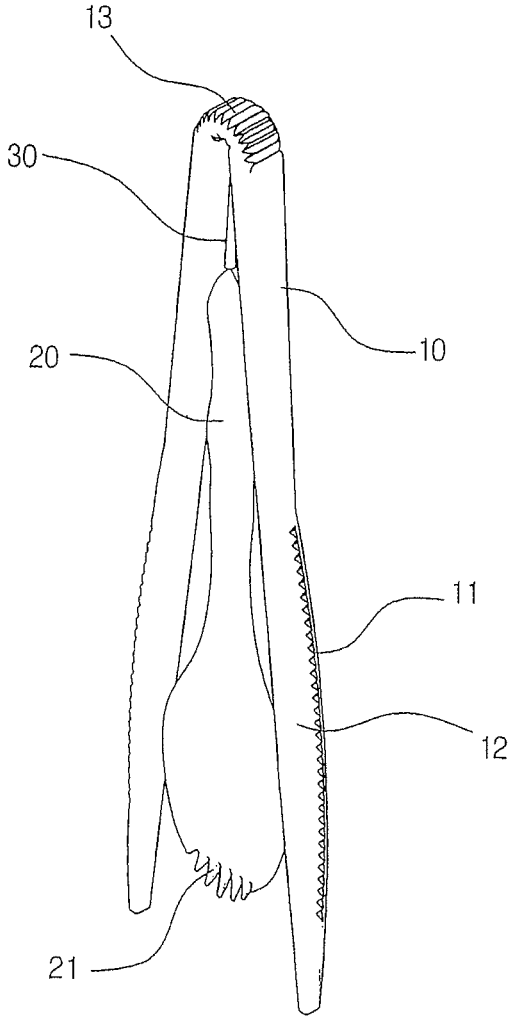
FIG. 2 is a perspective view of the multipurpose all-in-one eating utensil in accordance with an embodiment of the present invention.
Figure 3:
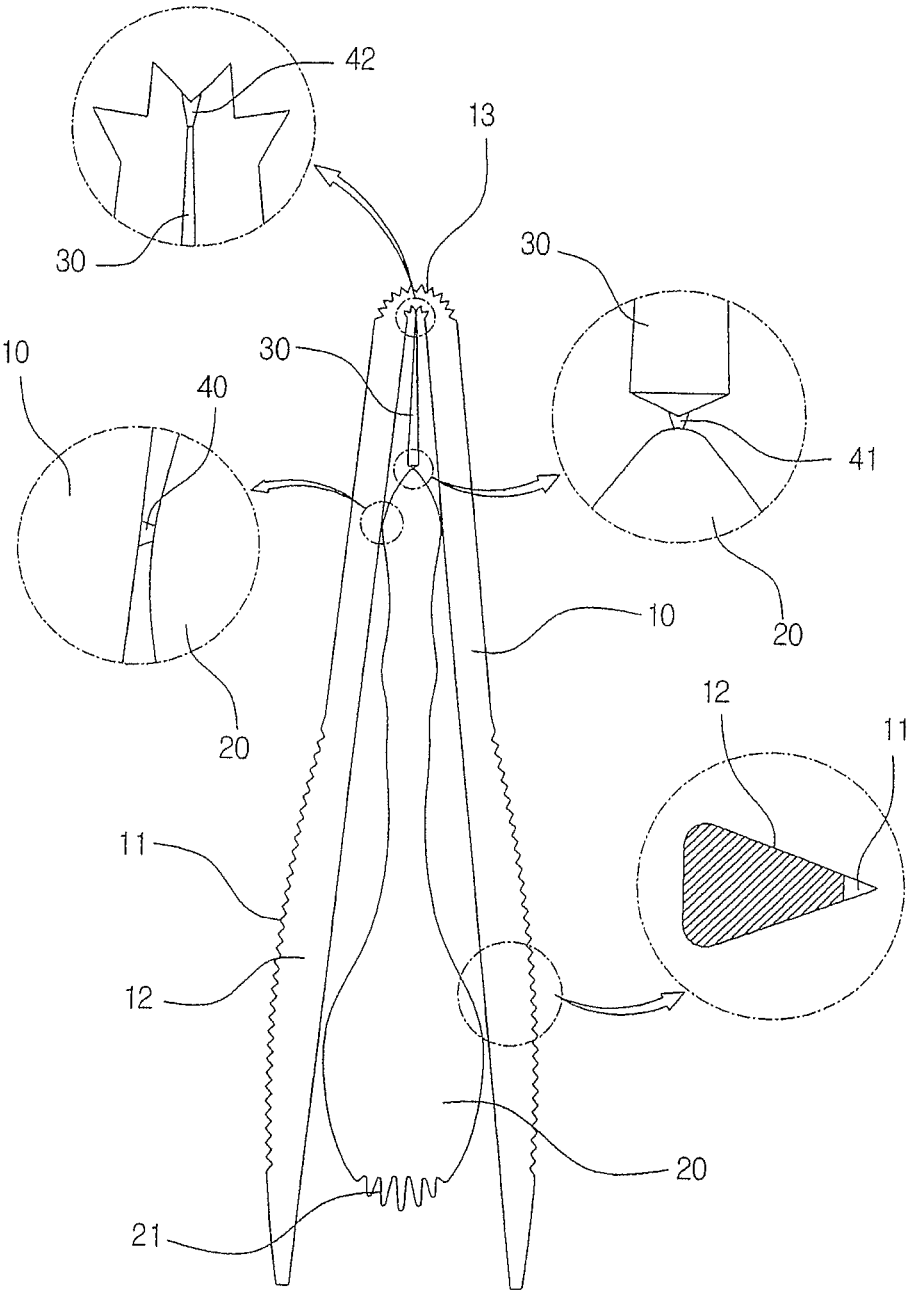
FIG. 3 is a front view of the multipurpose all-in-one eating utensil in accordance with an embodiment of the present invention. Magnified views of example portions are also illustrated.
Figure 4:
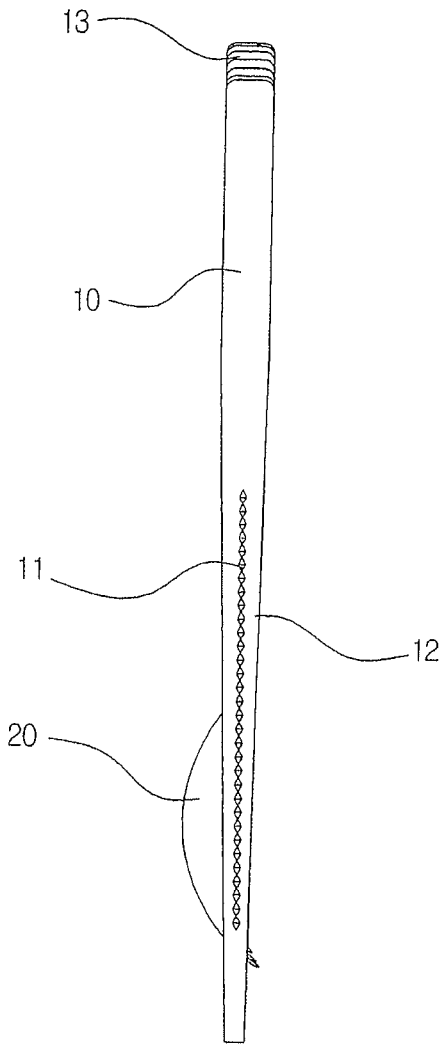
FIG. 4 is a side view of the multipurpose all-in-one eating utensil in accordance with an embodiment of the present invention.

FIG. 2 is a perspective view of an embodiment of the present invention. FIG. 3 is a front view of an embodiment of the all-in-one eating utensil, and FIG. 4 is a side view of an embodiment of the all-in-one eating utensil.

One embodiment according to the present invention is a multipurpose all-in-one eating utensil which allows users to use a spoon and chopsticks, knife and fork, and/or a toothpick all with just a single unified object (e.g., device or apparatus). Instead of producing each utensil separately and attaching them, the present invention provides economic efficiency and convenience of use by allowing users to use the spoon also as a fork and the chopsticks also as a knife. Other embodiments of the present invention may include one or more, but less than all, features of the embodiment illustrated in FIGS. 2-4.

For the current embodiment, a pair of elongated sticks is prepared as chopsticks (10). These chopsticks (10) are attached at their upper ends so that their lower ends are held apart. A spoon (20) and a toothpick (30) are located in between the chopsticks (10), where the spoon (20) is located on the inside and below the chopsticks (10) and the toothpick (30) is located above the spoon (20).

Further, the interior surface of the chopsticks (10) are connected to the exterior surface of the spoon (20) by Connector 1 (40) which can be separated when a sufficient force is applied. The top of the spoon (20) is attached to the bottom end of the toothpick (30) by Connector 2 (41) which can be separated when a sufficient force is applied. Also, the top end toothpick (30) is connected to the top portion of the chopsticks (10) by Connector 3 (42) which can be separated when a sufficient force is applied.

Thus, chopsticks (10), a spoon (20), and a toothpick (30) are all interconnected by Connector 1 (40), Connector 2 (41), and Connector 3 (42) to form a single unit (e.g., a single device or a single apparatus) allowing the present invention to be manufactured (e.g. injection molded) as a single unit. The described embodiment of the present invention can therefore be handled as one simple object until the utensils are separated by application of an appropriate external force.

In particular, the chopsticks (10) are shaped with an outward bulge containing repeating saw-tooth shaped serrations in the middle portion of the outer surface which include a Knife portion (12). The spoon (20) is shaped with fork tines at the bottom which include the Fork portion (21). Thus, the chopsticks (10) and spoon (20) can also function as a knife and fork respectively.

Figure 5:
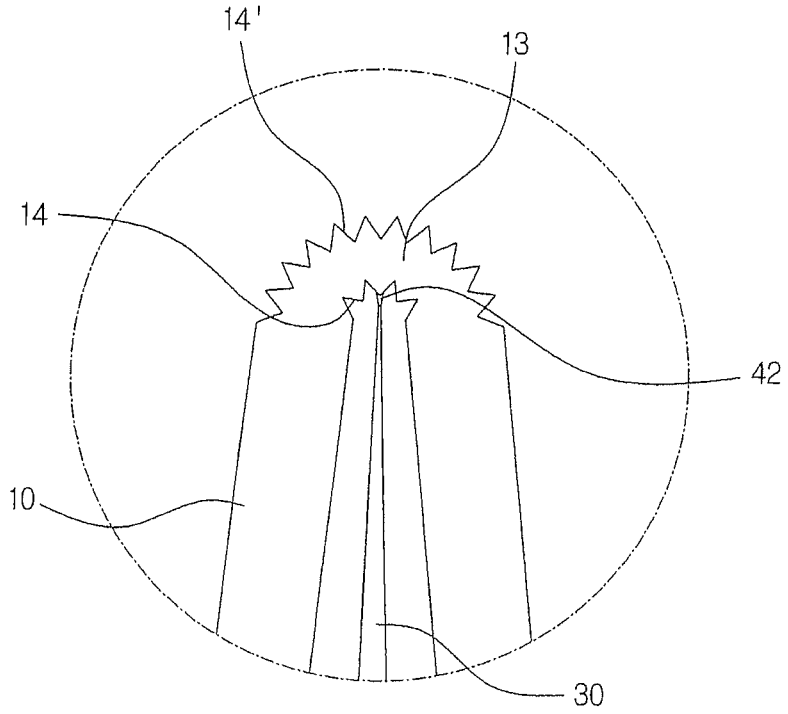
FIG. 5 is an enlarged front view of the top portion of the chopsticks where they are attached in accordance with an embodiment of the present invention.

The chopsticks (10) may be attached at their upper ends by a rounded Elastic portion (13), as shown in FIG. 5, which serves to not only hold the chopsticks together as a single unit but also functions to assist users who are not familiar with chopsticks to use chopsticks conveniently. When not in use, the bottom portion of the chopsticks may be maintained in a divergent position by the rounded Elastic portion (13) connecting the pair of chopsticks.

Therefore, when using chopsticks (10) according to embodiments of the present invention, users can hold the chopsticks (10) in their hands and use the chopsticks (10) to pick food up by closing the hand holding the chopsticks (10). When a user removes the force in the fingers of their closed hand holding the chopsticks (10), the elastic force of the Elastic portion (13) returns the chopsticks to their original shape of having the lower portions of the chopsticks diverge. This feature enables users, who may have had difficulty using traditional chopsticks that are not attached, to consume food effectively and conveniently using chopsticks even if they are unfamiliar with proper chopstick usage.

Chopsticks that are designed in the above manner are not only useful for foreigners and young children who are unfamiliar with chopsticks, but also make chopstick use more convenient even for normal users.

The Elastic portion (13) connecting the Chopsticks (10) according to embodiments of the present invention includes a repeating saw-tooth pattern (14)(14') on the interior and exterior surface. The saw-tooth pattern (14) (14') increases the life-span of the utensil by preventing any unwanted modification to the shape and form of the utensil from repeated compression and expansion of the Elastic portion (13) arising from repeated usage.

Figure 6:
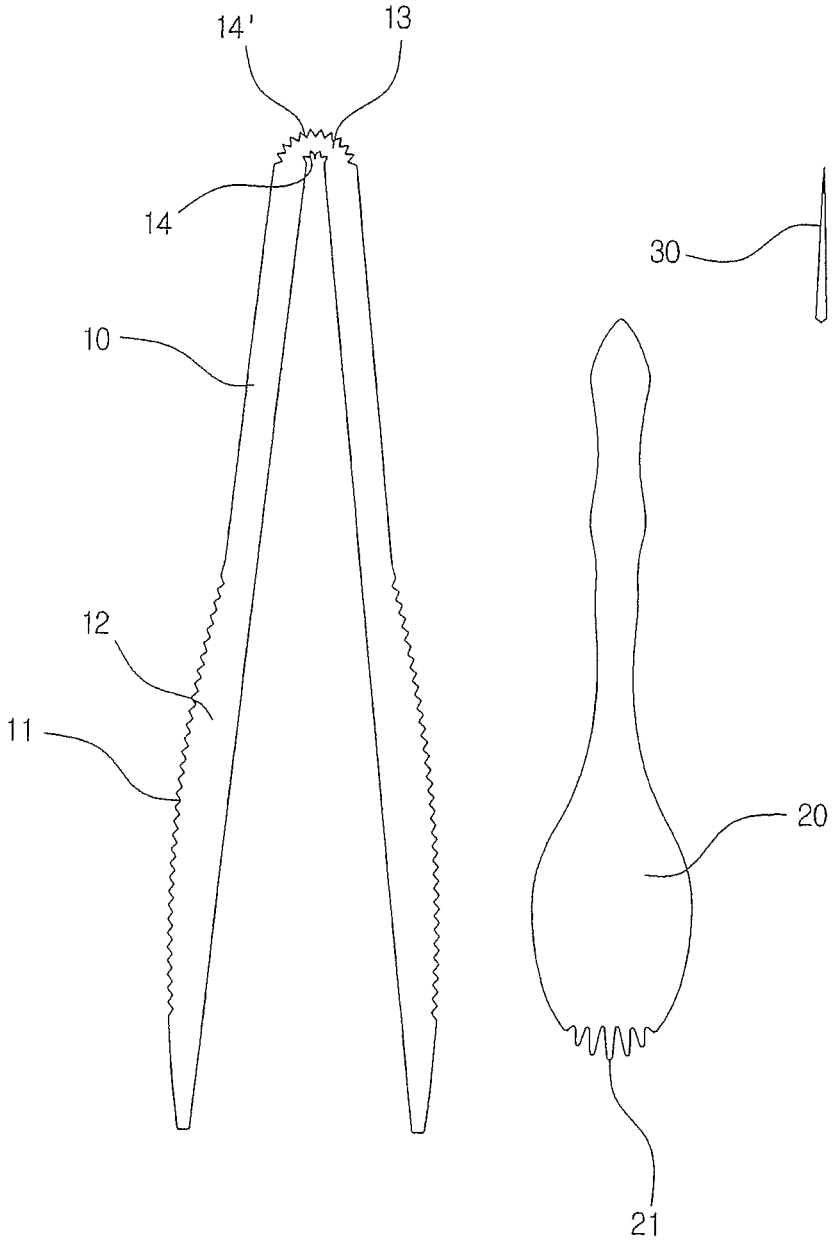
FIG. 6 is a front view of the multipurpose all-in-one eating utensil in a disassembled state, where each utensil has been detached in accordance with an embodiment of the present invention.

When attempting to consume a wide variety of foods using an eating utensil like the embodiment of the present invention described above, users can detach the utensils they need as shown in FIG. 6. Users can separate the Spoon (20) from the Chopsticks (10) and can use them in their original roles as a spoon and chopsticks. Additionally, the Knife portion (12) of the Chopsticks (10) can also be used as a knife for cutting food, while the Fork portion (21) of the Spoon (20) allows users to hold food in place while cutting or to skewer food items to eat.

A multipurpose all-in-one eating utensil such the one disclosed in an embodiment of the present invention may provide almost all the utensils necessary for consuming a meal without any inconvenience regardless of the type of food, the user's culinary culture, or their personal eating habits.

Embodiments of the present invention may be especially valuable for disposable lunches and in outdoor meal settings such as a picnic or camping. The embodiments according to the present invention may also be very useful for snack bars and restaurants by enabling them to provide customers with a single eating utensil such as embodied by embodiments of the present invention instead of having to prepare and provide a variety of eating utensils.

Also, when users want to get rid of any food stuck in between their teeth after consuming a meal with these utensils, users can use the toothpick (30) located near the upper portion of and in between the chopsticks (10). The toothpick can be detached by breaking Connector 3 (42) and then it can be used to pick food particles stuck in between the user's teeth.

One or more embodiments of the present invention provide almost every type of eating utensil a user may need in order to consume a meal regardless of the type or form of food being consumed or the user's own personal eating habits. By incorporating the functionality of two or more eating utensils into a single sub-part of the present invention, a product that is both economical and reasonable is achieved.

The present invention is described herein by way of examples and figures above with respect to what are presently considered to be example embodiments, and it is understood that no limitation of the scope of the invention is intended by the disclosed embodiments. Other embodiments may be utilized and derived therefrom, such that substitutes of equivalents or variants may be made without departing from the spirit and scope of this invention. It is understood that the present invention is intended to cover various modifications and equivalent arrangements included within the spirit and scope of the present invention and their equivalents. Figures are merely representational and may not be drawn to scale.

What is claimed is:

1. A multipurpose eating utensil comprising:

chopsticks that are coupled together at first ends by an attachment portion and diverged at second ends, the attachment portion having a convex outer edge;

a spoon comprising a bowl and a handle, and having fork tines at an end of the bowl; and a toothpick arranged between and coupled to the attachment portion and the handle of the spoon, wherein the spoon is located in between the two chopsticks and attached to inner edges at the first ends of the chopsticks by connectors where the connectors are configured to be broken when a proper force is applied.

2. The multipurpose eating utensil of claim 1, wherein one end of the toothpick is attached to one end of the handle by a connector while the opposite end of the toothpick is coupled an inner side of the attachment portion by a connector so that the toothpick is in between the spoon and the chopsticks.

3. The multipurpose eating utensil of claim 1, wherein the attachment portion is elastic so that the diverged second ends of the chopsticks are brought together when an external force is applied and the second ends naturally return to their original divergent position when the external force is removed.

4. The multipurpose eating utensil of claim 3, wherein the convex outer edge and an inner surface of the attachment portion have alternating ridges to prevent damage to the attachment portion from repeated usage.

5. The multipurpose eating utensil of claim 1, wherein the convex outer edge has saw-tooth serrations.

* * * * *